US007377507B2

(12) United States Patent
Yamamiya

(10) Patent No.: US 7,377,507 B2
(45) Date of Patent: May 27, 2008

(54) AUTOMATIC FLAT-ARTICLE DISPENSING APPARATUS

(75) Inventor: Takahito Yamamiya, Saitama (JP)

(73) Assignee: Asahi Seiko Co., Ltd, Tokyo (JP)

( * ) Notice: Subject to any disclaimer, the term of this patent is extended or adjusted under 35 U.S.C. 154(b) by 226 days.

(21) Appl. No.: 11/325,103

(22) Filed: Jan. 4, 2006

(65) Prior Publication Data

US 2006/0145411 A1 Jul. 6, 2006

(30) Foreign Application Priority Data

Jan. 5, 2005 (JP) ..... 2005-000331

(51) Int. Cl.
*B65H 3/08* (2006.01)

(52) U.S. Cl. ..... 271/11; 271/90; 221/226

(58) Field of Classification Search ..... 271/11, 271/90; 221/217, 226, 258, 229, 275
See application file for complete search history.

(56) References Cited

U.S. PATENT DOCUMENTS 4,993,587 A * 2/1991 Abe ..... 221/21
5,556,252 A * 9/1996 Kuster ..... 414/796.7
6,102,248 A 8/2000 Yamamiya
6,311,867 B1 11/2001 Yamamiya
6,443,442 B1 * 9/2002 Willis et al. ..... 271/11
6,981,698 B2 * 1/2006 Yamamiya et al. ..... 271/10.01
7,007,940 B2 * 3/2006 Polidoro et al. ..... 271/3.11
7,083,088 B2 * 8/2006 Yamamiya ..... 235/381
7,172,116 B2 * 2/2007 Yamamiya ..... 235/381

FOREIGN PATENT DOCUMENTS

JP 2001-118137 4/2001

* cited by examiner

*Primary Examiner*—Kaitlin S Joerger
(74) *Attorney, Agent, or Firm*—McGlew & Tuttle, P.C.

(57) ABSTRACT

An automatic flat-article dispensing apparatus which can dispense a relatively large and heavy flat articles without damaging the articles and without increasing the size of the apparatus and significantly increasing the energy consumption. The apparatus for dispensing a flat article, has a table which supports stacked flat articles and suction ports disposed over the table and facing the flat articles. A suction device provides suctions to hold the top flat article of the stacked flat articles by sucking air through the suction ports. A conveyance device conveys the flat article sucked via the suction port in a lateral direction with respect to the direction of the stack. The suction ports are a first suction port and a second suction port which are disposed in the lateral direction.

17 Claims, 12 Drawing Sheets

AUTOMATIC FLAT-ARTICLE DISPENSING APPARATUS

CROSS REFERENCE TO RELATED APPLICATIONS

This application claims the benefit of priority under 35 U.S.C. §119 of Japan Patent Application JP 2005-000331 filed Jan. 5, 2005, the entire contents of which are incorporated herein by reference.

FIELD OF THE INVENTION

The present invention relates to a dispensing apparatus which automatically sends out flat articles one by one. Specifically, the present invention relates to an automatic dispensing apparatus which issues, one by one, relatively large and heavy flat articles such as cases storing compact disks (CD) or digital video disks (DVD) or other discs or media or cards.

Flat article(s) used in the present specification includes a flat case encapsulating a disk which is a product, a flat article which is a product itself, and an article in which a flat article is covered by a film to which the flat article is attached.

BACKGROUND OF THE INVENTION

The applicant of the present application has proposed a technology disclosed in U.S. Pat. No. 6,311,867 and Japanese Patent Application Laid-Open No. 2001-118137 in order to dispense stacked flat articles having cards therein respectively, without causing any damage thereon.

This technology is such that, after the top flat article of stacked flat articles is suctioned by a suction device, the flat article is conveyed by a conveyance device which is in contact with the flat article by suction. This apparatus sends the held or suctioned top flat article by means of the conveyance device. The apparatus can, for example dispense a CD case, which has a CD therein and wrapped with a thin film, without damaging the CD case. However, in the embodiments disclosed in above patent specifications, since there is only a suction port of a fan, which is the suction device, when dispensing relatively heavy flat article such as a CD cases, the CD case which is suctioned by the suction port is moved in a lateral direction by the conveyance device, thus a part of the suction port is hidden by the flat particle.

Accordingly, the amount of air suctioned from an uncovered part of the opening increases at once, and the suction force to the flat article decreases drastically, whereby the flat article falls off the suction device, thus the flat article may not be transferred to the conveyance device in the next cycle. Moreover, when the flat article is transferred to the conveyance device in the next cycle, only a leading end portion of the flat article is held by the conveyance device, and other portions fall off the suction port, thus the wrapping film may be damaged by scraping against a peripheral wall.

Further, reinforcement of the suction device can be considered so that a flat article does not fall off the suction device. However, such causes an increase in the size of the apparatus and the consumption energy, thus this technology cannot be employed readily.

Furthermore, even when the conveyance device receives only a part of the flat article in the next cycle, the conveyance device may be able to convey without causing the flat article to incline, but this causes an increase in the size of the apparatus and the cost, and thus cannot be employed readily.

SUMMARY OF THE INVENTION

A first object of the present invention is to provide an automatic dispensing apparatus which can dispense a relatively large and heavy flat article without damaging it.

A second object of the present invention is to provide an automatic dispensing apparatus which can dispense a relatively large and heavy flat article, without increasing the size of the apparatus and significantly increasing the consumption energy.

In order to achieve these objects, the present invention provides an automatic flat-article dispensing apparatus, comprising: a table or platform which supports stacked flat articles; a suction port which is disposed over the table and faces the flat articles; and a suction device which suctions and sticks the top flat article of the stacked flat articles to the suction device by sucking air through the suction port. A conveyance device is provided which conveys the flat article sucked via the suction port in a lateral direction with respect to the direction of the stack. The suction port has at least a first suction port and a second suction port which are disposed in the lateral direction.

With the configuration of the first suction port and the second suction port disposed in the lateral direction, the flat article is suctioned by suction airflow which is drawn into at least the first suction port and second suction port created in the suction device. In other words, the flat article is suctioned by at least the first suction port and second suction port which are arranged in a conveyance direction of the flat article. In this suction state, the flat article is moved by the conveyance device in the lateral direction with respect to the direction of the stack. By moving the flat article in the lateral direction, the first suction port which is covered by the flat article is no longer covered by the flat article gradually. Therefore, the suction force of the first suction port to the flat article, where a part of the first suction part is not covered, drastically decreases. However, the second suction port is covered by the flat article entirely, and thus has a large suction force. The flat article is conveyed by the conveyance device in the lateral direction while being suctioned by the second suction port.

The flat article is then sent to the next cycle. While being sent to the next cycle, the flat article is suctioned by at least the second suction port, thus the flat article can be transferred to the next cycle securely. Moreover, with the simple structure having at least the first suction port and the second suction port, the suction device does not have to be increased in its size. In addition, since the suction device does not have to be powerful, the suction device can be realized without significantly increasing the consumption energy and the cost.

According to another aspect off the invention an equalizer box may be provided with a predetermined thickness, which is sectioned by a partition wall in the lateral direction. This comprises a first chamber and second chamber. An end face of the first chamber forms the first suction port, and an end face of the second chamber forms the second suction port. A suction airflow generation device is attached to an opening opposite to the suction ports of the first chamber and the second chamber. According to this configuration, the suction airflow generation device suctions air from the first suction port and the second suction port, which are sectioned by the partition wall, via the first chamber and the second chamber. During operation, in the first chamber and the second chamber corresponding to the first suction port and the second suction port, suction negative pressure is equalized, whereby substantially equalized negative pressure is generated through out the entire surfaces of the suction ports. Therefore, the flat article is suctioned by a suction force which is substantially equalized throughout the entire surfaces of the suction ports.

When the flat article is moved by the conveyance device in the lateral direction, the flat article is removed from the first suction port first, and the suction force of the first suction port no longer acts in effect. However, since the flat article covers the entire region of the second suction port, the flat article is conveyed by the conveyance device to the next cycle, while being suctioned by the large suction force of the second suction port.

Therefore, with the simple structure of the equalizer box which is sectioned in the lateral direction, at least the first suction port and the second suction port can be formed, thus the suction airflow generation device can be configured at low cost without increasing its size.

According to a another aspect off the invention the automatic flat-article dispensing apparatus may be provided with the suction airflow generation device as an axial-flow fan which is rotated by an electric motor. In this configuration, since the suction airflow generation device is an axial-flow fan which is rotated by an electric motor, there are advantages that the suction airflow generation device is not increased in its size and is inexpensive.

The present invention is an automatic flat-article dispensing apparatus, comprising: a table which supports stacked flat articles; a suction port which is disposed over the table and faces the flat articles; a suction device which suctions the top flat article of the stacked flat articles by sucking air through the suction port; and a conveyance device which conveys the flat article sucked by the suction port in a lateral direction with respect to the direction of the stack, wherein an equalizer box with a predetermined thickness has a first chamber and second chamber which are sectioned by a partition wall in the lateral direction, an end face of the first chamber being the first suction port, an end face of the second chamber being the second chamber, and a suction airflow generation device is attached to an opening opposite to the suction ports of the first chamber and the second chamber.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
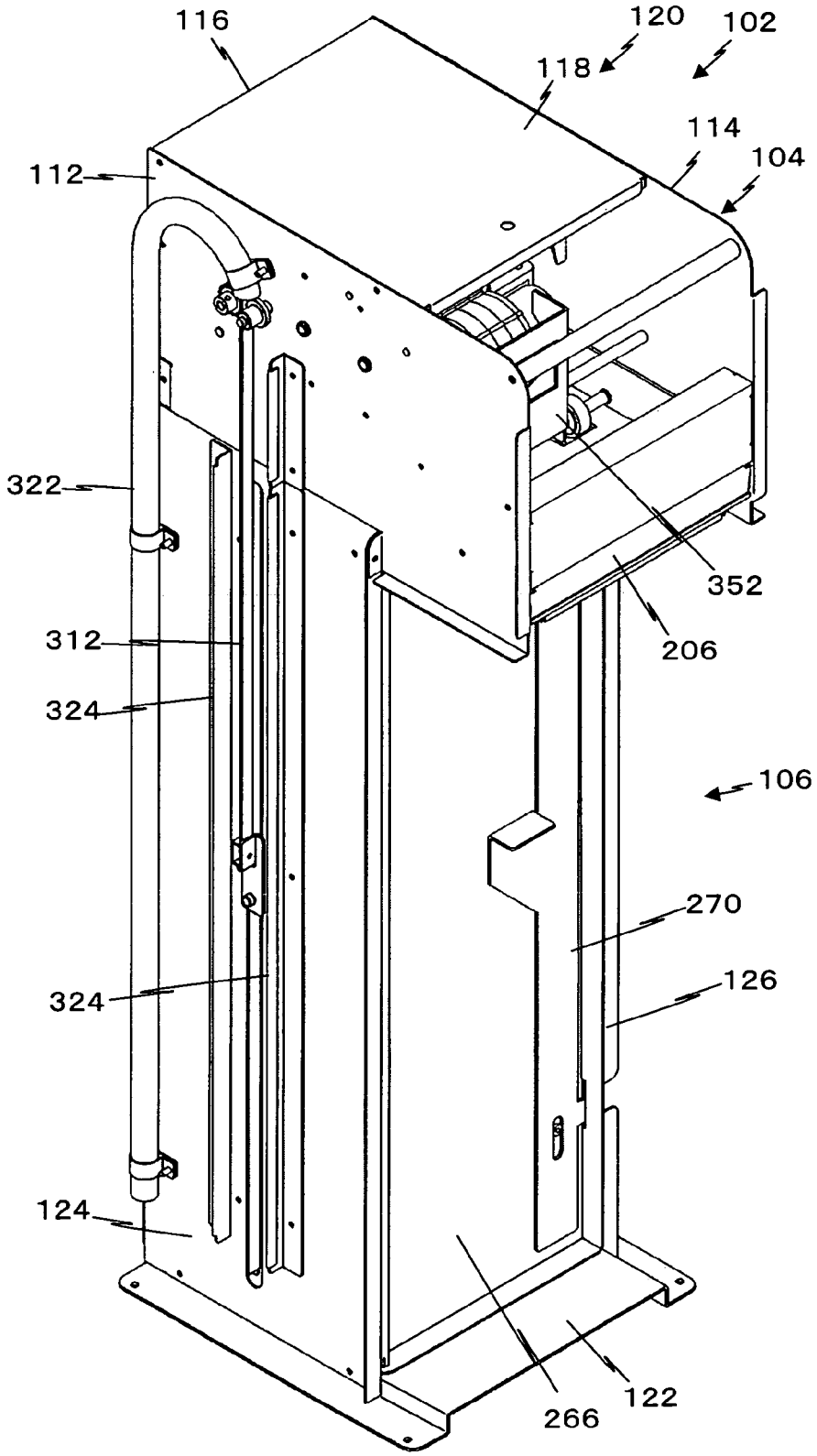
FIG. 1 is a perspective view which is viewed from upper left of an automatic flat-article dispensing apparatus according to an embodiment of the invention.

Referring to the drawings in particular, an automatic dispensing apparatus 102 is provided for dispensing a flat article 100, for example, a CD case. The automatic dispensing apparatus 102, has a dispensing portion 104 and a storage portion 106. The storage portion 106 is fixed to left and right side frames 112, 114 and a rear frame 116 which configure the dispensing portion 104, and a dispensing portion frame 120 is configured by a top plate 118. The dispensing portion frame 120 is detachably attached to right and left holding portion side frames 124, 126 provided in a base frame 122, and to a holding portion rear frame 128. In the case of a break down based on the configuration units of the dispensing portion 104, it can be fixed by replacing it with a new dispensing portion 104.

Figure 3:
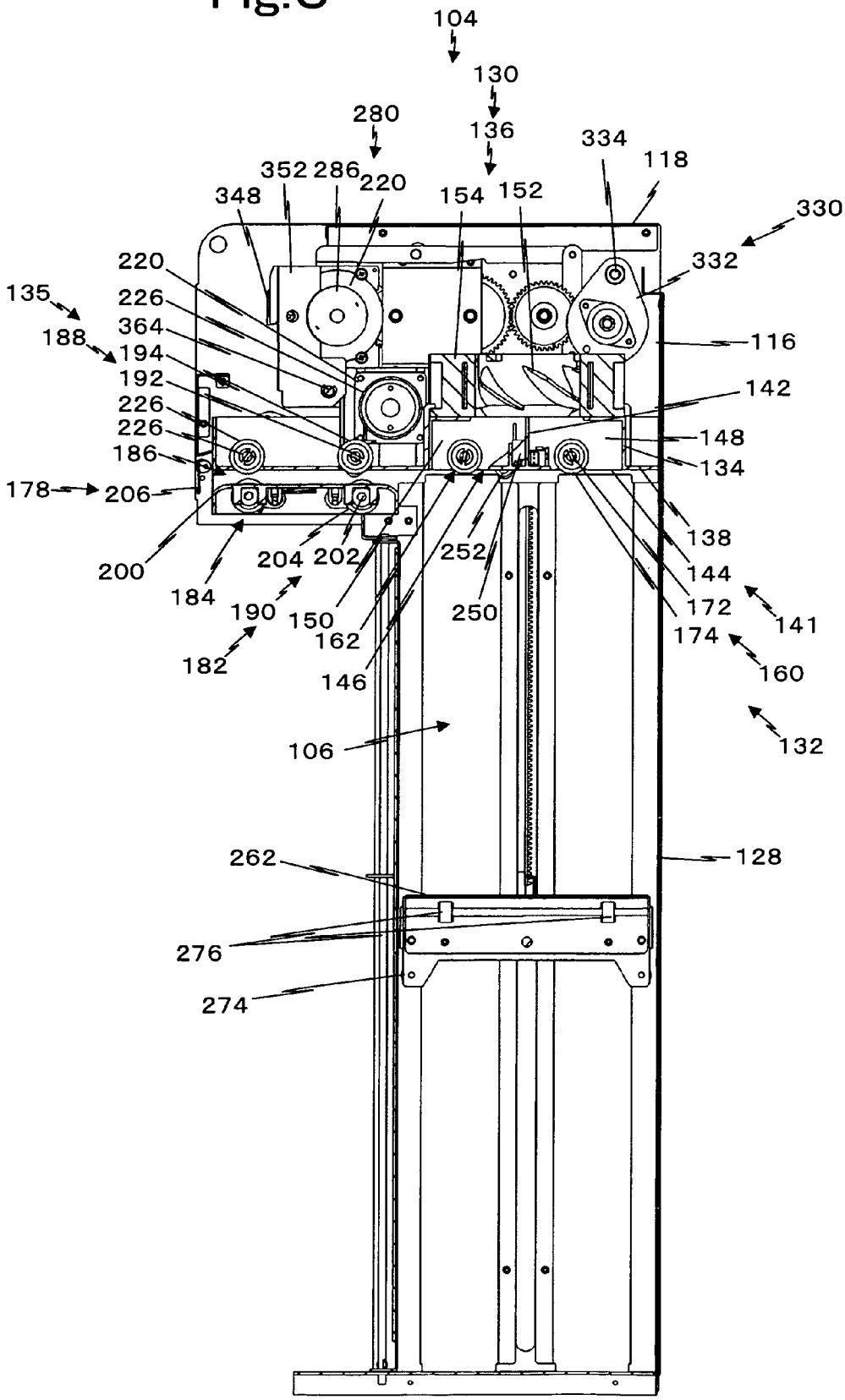
FIG. 3 is a cross-sectional view taken along line A-A in FIG. 5.

As shown in FIG. 3, the dispensing portion 104 has a suction device 130, lateral direction conveyance device 132, and a dispensing device 135. The suction device 130 is explained first.

The suction device 130 has a function of suctioning the flat article 100 by means of suction airflow. The suction device 130 has a cylindrical equalizer box 134 and a suction airflow generation device 136. The equalizer box 134 is in a form of a cylinder such that a hollow portion thereof extends in a vertical direction, and is integrally resin-molded with a base 138, which is attached substantially horizontally between the left side frame 112 and right side frame 114. However, the equalizer box 134 can be constructed separately from the base 138 and fixed to the base 138. The equalizer box 134 has a suction port 141, a lower end face of which is formed into a rectangle.

The suction port 141 is divided into a first suction port 144 and a second suction port 146 by a thin conveyance direction partition wall 142 which intersects with a conveyance direction D of the lateral direction conveyance device 132 and extends in a direction perpendicular to the conveyance direction D. The equalizer box 134 has a predetermined thickness, a first chamber 148 having the first suction port 144 on an end face thereof, and a second chamber 150 having the second suction port 146 on an end face thereof. The first chamber 148 and the second chamber 150 have a predetermined capacity which is determined by an opening area of each of the chambers and the thickness of the equalizer box 134. When the first chamber 148 and the second chamber 150 have a predetermined capacity, even when the suction force of the suction airflow generation device 136 fluctuates as time progresses, there is an advantage that the capacity can function as a cushion, whereby the flat article 100 can be prevented from being caused to fall by drastic decrease of the suction force.

Figure 6:
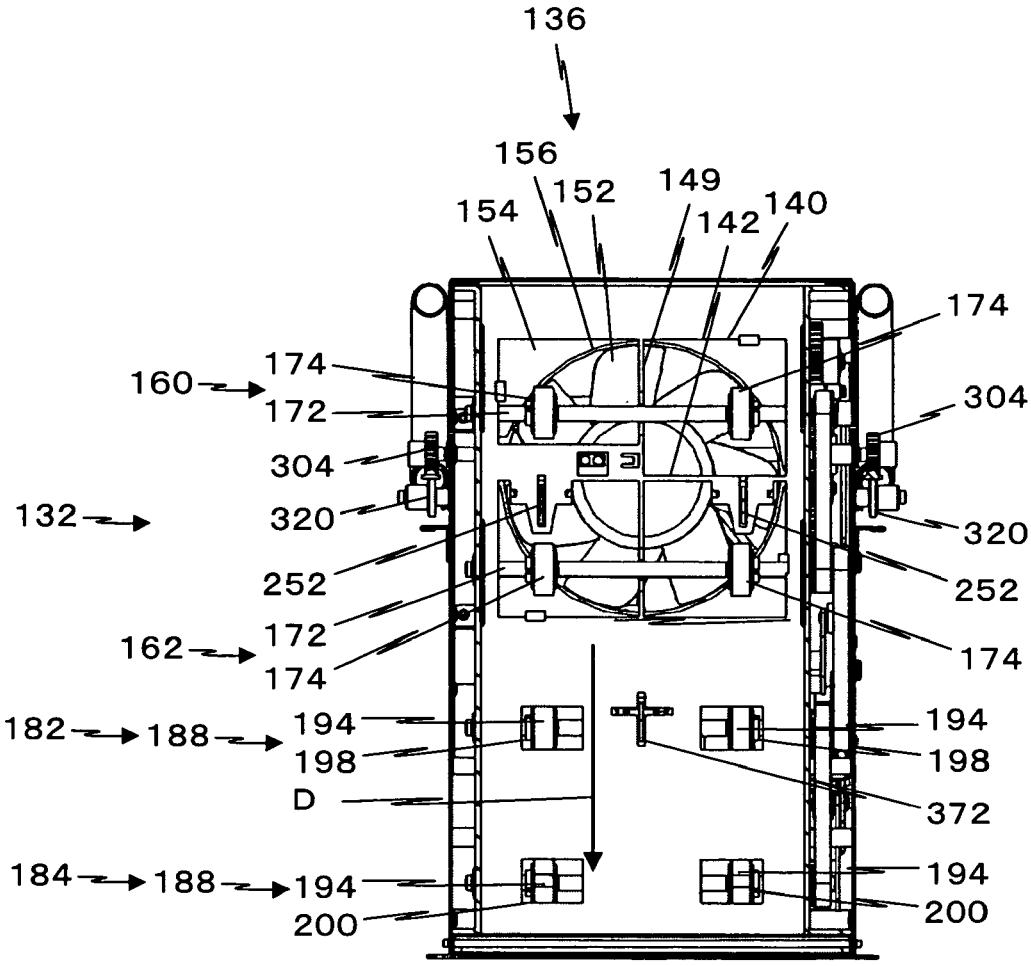
FIG. 6 is a cross-sectional view taken along a line C-C of FIG. 7.

The dispensing device 135 is attached to the dispensing portion frames 112, 114. As shown in FIG. 6, the conveyance direction partition wall 142 is reinforced by a thin partition wall 149 which extends in the conveyance direction at the center of the conveyance direction partition wall 142. The suction airflow generation device 136 generates airflow for suctioning from the first suction port 144 and the second suction port 150. The suction airflow generation device 136 has an axial-flow fan 152 which is rotated by a first electric motor 151 rotating around a substantially perpendicular axis of rotation. The axial-flow fan 152 is disposed inside a circular hole 156 of a casing 154, and is fixed to an output axis of the first motor 151, the output axis being fixed to a stay 158 on an upper surface of the casing 154. The axial-flow fan 152 is fixed to an upper surface of the equalizer box 134. In other words, the suction airflow generation device 136 is attached opposite an opening of the equalizer box 134 positioned opposite to the first suction port 144 which is the end face of the first chamber 148 and to the second suction port 146 which is the end face of the second chamber 150. The suction airflow generation device 136 suctions air from the suction ports 144 and 146. As the axial-flow fan 152 rotates, the air is introduced from the first suction port 144 and the second suction port 146 into the equalizer box 134, and airflow going upward is generated. The suction airflow generation device 136 can employ a system for generating suction airflow by means of an ejector effect. Moreover, the suction airflow generation device 136 may cause the axial-flow fan 152 to rotate by means of an air motor.

The lateral direction conveyance device 132 has the function of conveying the flat article 100, which is suctioned by the suction device 130, in a lateral direction. The lateral direction conveyance device 132 then sends the flat article 100 to the next cycle. The lateral direction conveyance device 132 is disposed inside the equalizer box 134. A circumferential surface of the lateral direction conveyance device 132 slightly protrudes downward from the first suction port 144 and the second suction port 146 in order to convey the flat article 100, which is suctioned by the first suction port 144 and the second suction port 146, to the dispensing device 135 which is in the next cycle. In the embodiment shown, the lateral direction conveyance device 132 has a first roller device 160 disposed inside the first chamber 148 and a second roller device 162 disposed inside the second chamber 150. The first roller device 160 is configured by two rollers 174 which are fixed, at a predetermined interval, to rotating axes 172 which are horizontally attached to a side wall 170 of the equalizer box 134 in a rotatable fashion. The second roller device 162 has the same configuration as the first roller device 160. Therefore, lower portions of the roller 174 slightly protrude from a lower end of the equalizer box 134. For this reason, when the flat article 100 is suctioned by the first suction port 144 and the second suction port 146, air is suctioned from a small space between the lower end of the equalizer box 134 and the flat article 100. Accordingly, the first electric motor 151 is prevented from overheating, frictional contact between the article 100 and the lower end of the equalizer box 134 is avoided, and conveyance resistance of the flat article 100 is minimized. However, when the interval of time for conveying the flat article 100 is long, the lower end of the equalizer box 134 may be caused to contact with the flat article 100. Circumferential surfaces of the rollers 174 are covered with a rubber in order to minimize slippage with the flat article 100. The lateral direction conveyance device 132 can use a belt instead of the rollers to move the flat article in the direction of the dispensing device 135.

The dispensing device 135 disposed laterally in the equalizer box 134 is explained next. The dispensing device 135 conveys the flat article 100, which is sent from the lateral direction conveyance device 132, to a dispensing port 178. In the embodiment, the dispensing device 135 has a first nip and conveyance device 182 and a second nip and conveyance device 184 which are disposed along a dispensing path 186. The first nip and conveyance device 182 and the second nip and conveyance device 184 have the same configuration, thus the first nip and conveyance device 182 is mainly described. The first nip and conveyance device 182 has an upper roller device 188 disposed on an upper side of the dispensing path 186 of the flat article 100, and a lower roller 190 disposed on a lower side of same. The upper roller device 188 has a shaft 192 which is rotatably supported by the base 138, and rollers 194 which are fixed to the shaft 192 at a predetermined interval. Lower portions of these rollers 194 protrude from an opening 198 provided in the base 138 to the dispensing path 186. Lower surfaces of the rollers 194 are installed so as to be located on the same horizontal line as the lower surfaces of the rollers 174 of the first roller device 160 and the second roller device 162 of the lateral direction conveyance device 132. The lower roller device 190 is attached to a support plate 200 which is disposed parallel with the base 13 at a predetermined interval in a lower part of the base 138. The lower roller device 190 can be rotated with respect to the support plate 200, and has a shaft 202 which is movable so as to separate from the dispensing path 186, and a roller 204 which is fixed to the shaft 202 at a predetermined interval. The rollers 204 are disposed opposite to the rollers 194 respectively. The second nip and conveyance device 184 also has the same configuration. The lower roller device 190 is elastically biased so as to protrude to the dispensing path 186, and nips the flat article 100 with the upper roller device 188 by means of predetermined force.

A shutter 206 is attached to the side frames 112, 114 in an end portion of the dispensing path 186 in a pivotally operable fashion. The shutter 206 is regulated by a stopper (not shown) so as not to pivotally operate counterclockwise further than a state shown in FIG. 3, and is pivotally operable clockwise by being pressed by the flat article 100.

Figure 7:
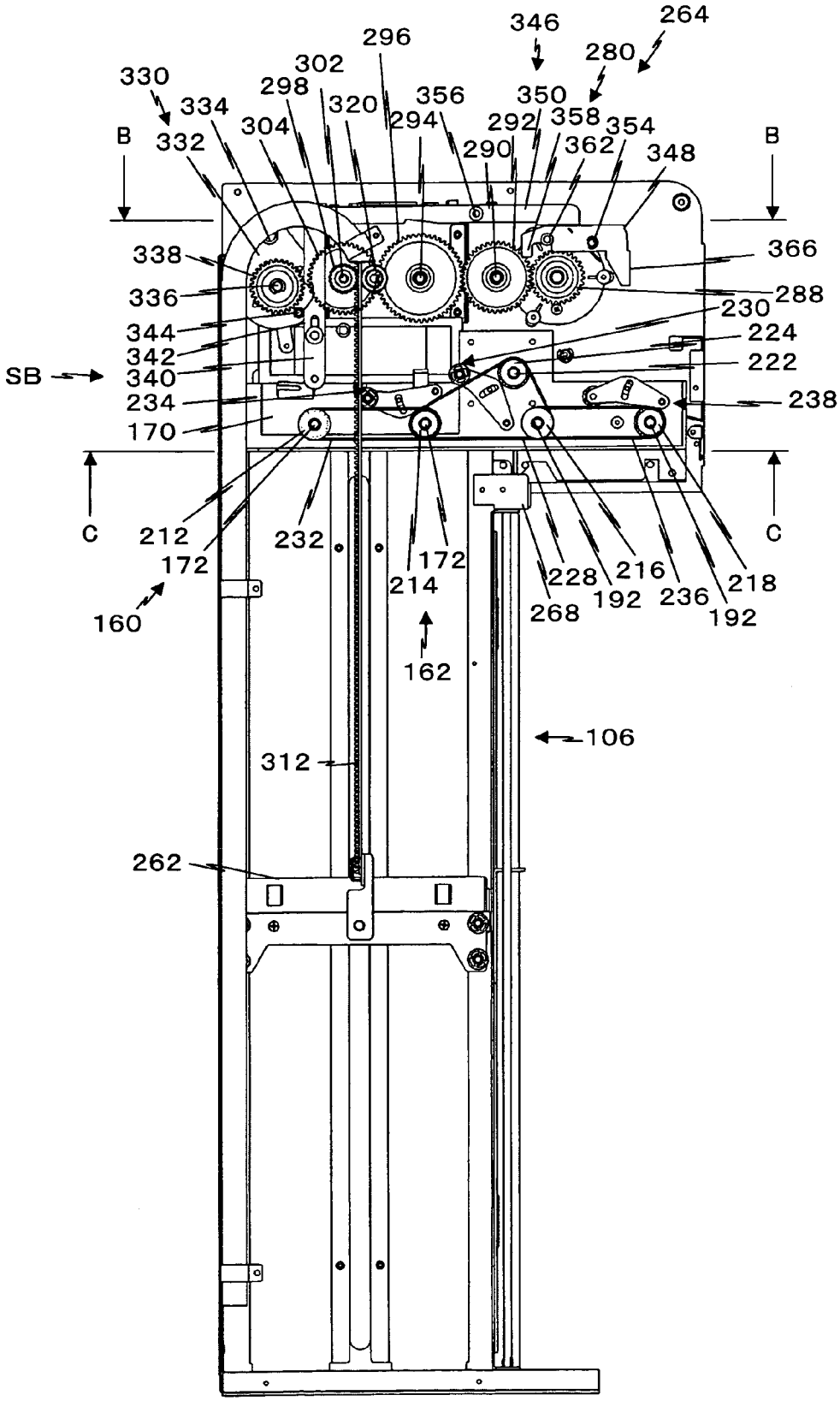
FIG. 7 is a left side view showing a state in which a left cover, of the automatic flat-article dispensing apparatus according to the embodiment of FIG. 1, is removed.

A driving device 210 of the lateral direction conveyance device 132 and the dispensing device 135 is described next with reference to FIG. 3 and FIG. 7. Synchronous pulleys 212, 214, 216, and 218 with the same diameter are fixed respectively to left end portions at the rotating axes 172 of the first roller device 160 and the second roller device 162, as well as the shafts 202 of the first nip and conveyance device 182 and the second nip and conveyance device 184, the left end portions protruding from the wide wall 170. As shown in FIG. 3, a speed reducer 220 is fixed to the base 138, and a pulley 224 having the same diameter as the above pulleys is fixed to an output axis 222 of the speed reducer 220. The speed reducer 220 is rotated by a second electric motor 226 fixed thereto. The pulleys 224, 214, and 216 are wound by a toothed belt 228. The belt 228 is provided with predetermined tension by a tensioner 230. The pulleys 212 and 214 are wound by a tooted belt 232 and are provided with predetermined tension by a tensioner 234. The pulleys 216 and 218 are wound by a tooted belt 236 and are provided with predetermined tension by a tensioner 238. Therefore, the pulley 224 is rotated counterclockwise in FIG. 7 by rotation of the second motor 226 in a predetermined direction, whereby the pulleys 212, 214, 216, and 218, that is, the rollers 174, 204 are rotated in the same direction. Accordingly, the flat article 100 which is in contact with each of the rollers 174 or 204 is conveyed toward the dispensing port 178.

A detection sensor 250 of the flat article 100 is attached to the partition wall 142, and a lower end of a contact 252 of the detection sensor is positioned lower than a lower surface of the roller 174. Therefore, when the flat article 100 approaches a predetermined distance, the detection sensor 250 is pressed by the contact 252 and thereby outputs a detection signal.

Figure 2:
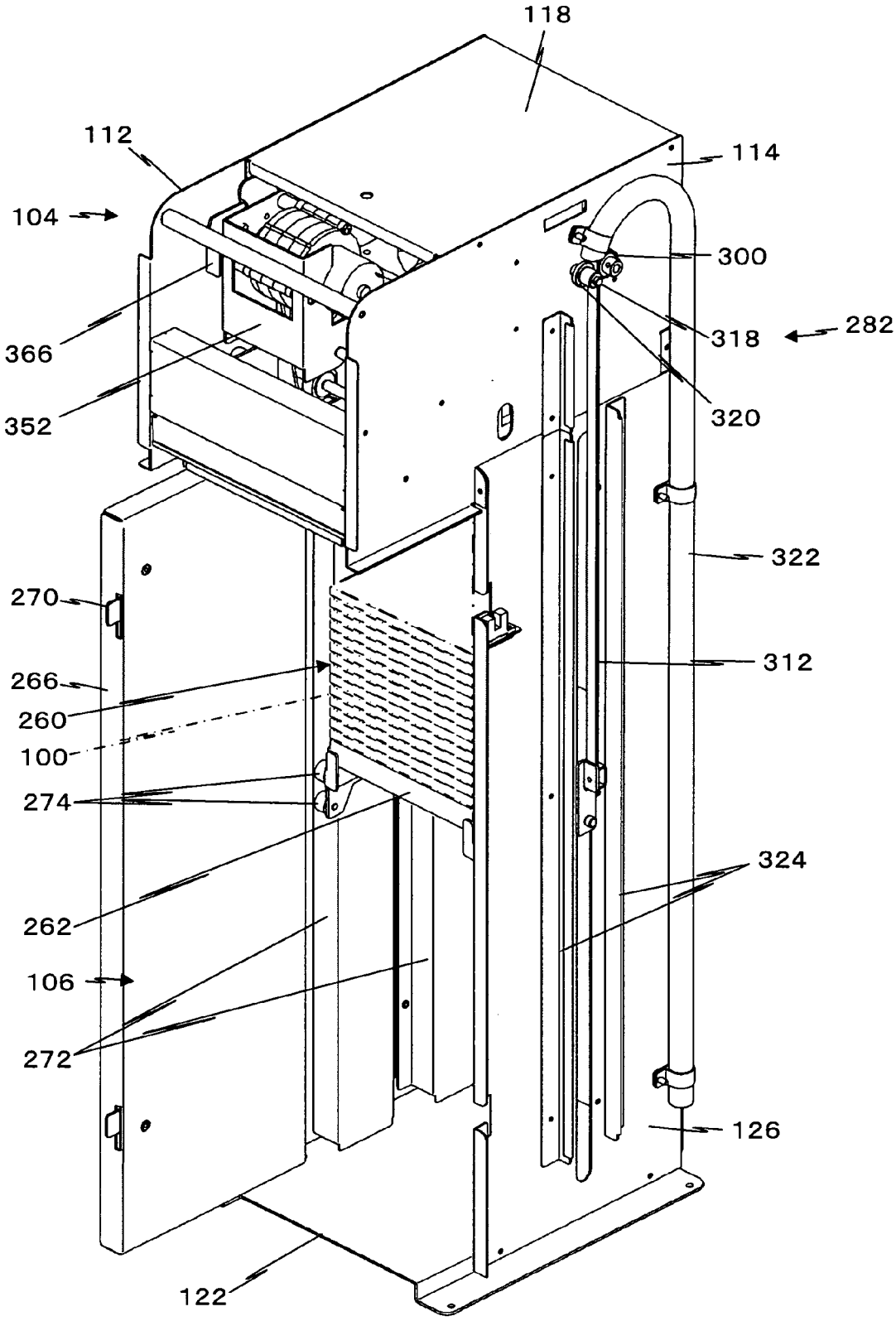
FIG. 2 is a perspective view which is viewed from upper right in a state in which a supplementary door, of the automatic flat-article dispensing apparatus according to the embodiment of FIG. 1, is opened.

The storage portion 106 of the flat article 100 is described next. As shown in FIG. 2, the storage portion 106 has a storage chamber 260 which extends in a vertical direction, a table 262 which moves the flat article 100, and a moving device 264 of the table 262. The storage chamber 260 is a rectangular cylinder-shaped space surrounded by the holding portion side frames 124, 126, and 128, and extending vertically in a lower part of the suction device 130. A lower end portion of a door 266 is attached to the base frame 122 in a rotatable fashion, an upper end portion of same is rotatably attached to a stay 268 fixed to the side frame 124, and is locked to the side frame 126 by a lock device 270 in a position in which the storage chamber 260 is closed. The door 266 is opened and the flat article 100 stacked on the table 262. The table 262 is in a form of a rectangular plate, and is movable so as to approach or separate from the equalizer box 134 in a lower part of the equalizer box 134 inside the storage chamber 260. Specifically, the table 262 is movable so as to approach or separate from the first suction port 144 and the second suction port 146 which are positioned in a vertical direction of the table 262. In order to move smoothly, the table 262 is guided in an anteroposterior direction by guide rollers 274 which are attached so as to have a guide column 272 therebetween, the guide column 272 extending substantially vertically to surfaces in the side frames 124 and 126, and is guided in a longitudinal section by guide rollers 276 which are attached to both sides of the table 262 The table 262 has the function of moving the flat article 100. Other mechanisms can be employed as long as the table 262 has this function.

Figure 4:
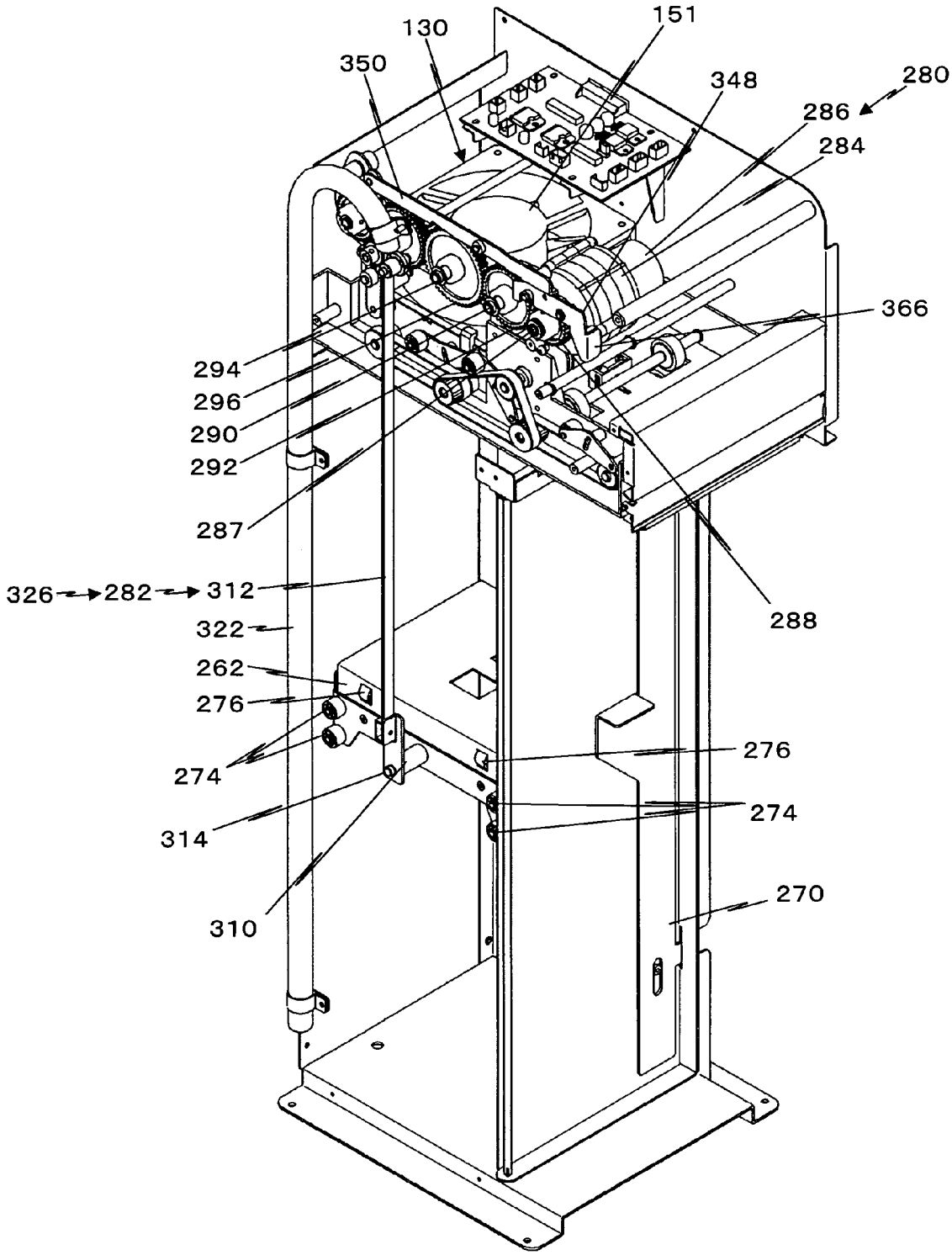
FIG. 4 is a perspective view which is viewed from an upper left portion in a state in which a left and upper part covers, of the automatic flat-article dispensing apparatus according to the embodiment of FIG. 1, are removed.

The moving device 264 is described next with reference to FIG. 4 and FIG. 7. The moving device 264 has a driving device 280 and a transmitting device 282. The driving device 280 has a speed reducer 284 which is disposed laterally in the suction device 130 and attached to the base 138, a third electric motor 286 which is fixed to the speed reducer 284 and drives the speed reducer 284, a driving gear 288 which is fixed to an output axis 287 of the speed reducer 284, a fixed axis 290 which is fixed to the base 138, an intermediate gear 292 which is attached rotatably to the fixed axis 290 and engages with the driving gear 288, a fixed axis 294 which is fixed to the base 138, an intermediate gear 296 which is rotatably attached to the fixed axis 294, and a rotating axis 302 both end portions of which protrude from the side frames 124 and 126, respective end portions of which are fixed with a pinion gear 298, 300, and which has a driven gear 304 engaging with the intermediate gear 296. The driving device 280 has a function of causing the table 262 to approach or separate from the suction device 130 via the transmitting device 282. Therefore, other mechanisms can be employed as long as the driving device 280 has this function.

The transmitting device 282 is described next with reference to FIG. 1 and FIG. 4. The transmitting device 282 with the same configuration is disposed laterally in each of the side frames 124 and 126, and the transmitting device 282 on the left side is mainly described. A stay 310 which protrudes laterally from the table 262 is attached with a lower end of a flexible rack 312 by a pin 314 in a pivotable fashion. The rack 312 is molded with a flexible resin and thus has flexibility. An intermediate portion of the rack 312 engages with the pinion gear 298. The rack 312 is pressed, at the back thereof, by a pinch roller 320 which is rotatably supported by a fixed axis 318 protruding from the side frames 124 and 126 respectively, whereby engagement with the pinion gear 298 is supported. A leading end portion of the rack 312 is inserted into a pipe 322 in a form of an inverted character J, which is fixed to side faces of the side frames 124 and 126, and is then returned to the base frame 122 side. By disposing the transmitting device 282 to have a shape of J or U by means of the flexible rack 312, a compact configuration of the transmitting device 282 can be created; which is suitable for miniaturazion. Guide rails 324, cross sections of which form an angle, and which are disposed at front and rear sides of the rack 312, is fixed to the side frames 124 and 126 at a predetermined interval. When the rack 312 is bent by at least a predetermined amount and contact with the guide rails 324, the rack 312 is prevented from being blocked by the guide rails 324 and further bent, in order to prevent buckling of the rack 312. The moving device 264 in the embodiment is a lifting device 326 since it moves the table 262 up and down. The moving device 264 may have the function of changing the distance between the suction device 130 and the flat article 100 to a predetermined distance. Therefore, the moving device 264 may fix the table 262 to move the dispensing portion 104. However, when moving the dispensing portion 104, the position of the dispensing port 178 is changed, thus it is preferred that the table 262 be moved. Moreover, the driving device 280 and the transmitting device 282 can be integrated. For example, the moving device 264 may be configured by laterally providing a linear motor or magnet plate in the base 138 and connecting the table to a coil plate.

The above-described detection sensor 250 is described next with reference to FIG. 3 and FIG. 6. Two of the detection sensors 250 are fixed to the base 138 at a predetermined interval, the base 138 being disposed horizontally. The contact 252 of the detection sensor 250 is disposed in a space in an upper portion of the storage chamber 260, and a lower end of the contact 252 is positioned lower than a lower end of the roller 174. When the contact 252 is slightly lifted up by the flat article 100, the detection sensor 250 outputs an ON signal. At this moment, when the two detection sensors 250 are switched ON, the positions of the contacts 252 are determined such that the ON signal is output eventually. Specifically, it is detected that the top flat article 100 contacts the both rollers 174 and is suctioned completely. Further, the detection sensor 250 is attached so as to be able to adjust the position thereof in a vertical direction in FIG. 3. The detection sensor 250 can use a sensor of other type such as a photoelectric sensor. However, by using a mechanical sensor where the contact 252 is used as in the embodiment, maintenance such as periodical cleaning does not need to be performed, thus a further inexpensive sensor can be achieved.

A fall prevention device 330 for preventing the table 262 from falling is described next with reference to FIG. 3 and FIG. 7. The fall prevention device 330 has a function of preventing the table 262 from falling rapidly by the weight of the flat article 100, when the transmitting device 282 is released from the driving device 280. This function is provided in order to prevent the flat article 100 from being damaged or the like by the rapid fall of the table. It is preferred that the fall prevention device 330 uses a unidirectional torque limiter 332. The unidirectional torque limiter 332 has the function of having predetermined rotational resistance when an input axis receives a torque in a predetermined direction, and having almost no rotary resistance when the input axis receives a torque in an opposite direction. Therefore, when the table 262 is lifted down in order to resupply the flat article 100, predetermined rotational resistance is received from the torque limiter 332, whereby the table 262 does not fall suddenly. Further, when the table 262 is lifted up by means of the driving device 280 and the transmitting device 282, drive resistance is not generated, whereby the drive energy is reduced.

Figure 8:
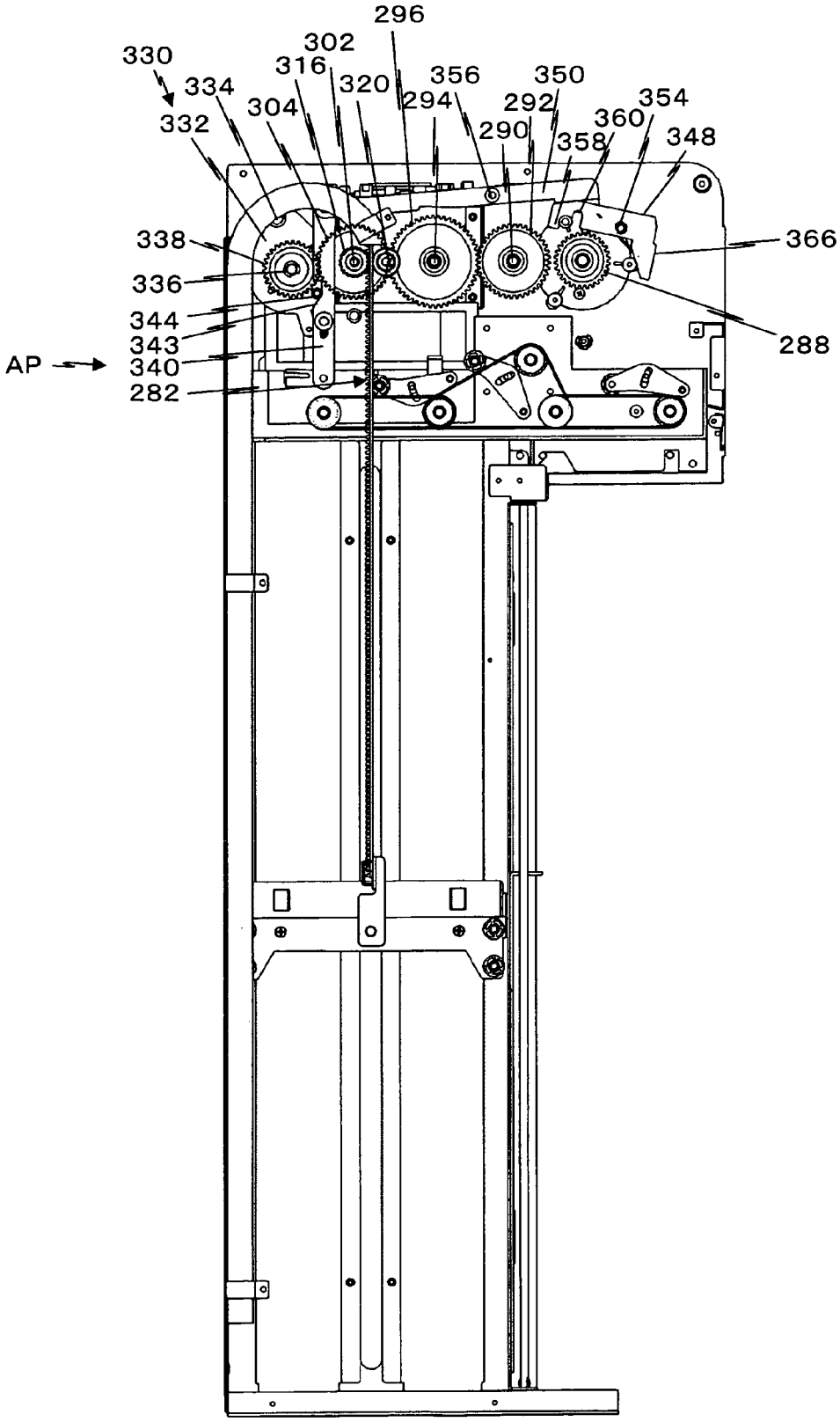
FIG. 8 is an explanatory diagram of an action of the automatic flat-article dispensing apparatus according to the embodiment of FIG. 1.

The unidirectional torque limiter 332 is provided in a fixed axis 334 protruding from the left side frame 112, in a pivotally operational fashion. A gear 338 is fixed to an input axis 336 of the torque limiter 332, and when the torque limiter 332 is pivotally operated counterclockwise in FIG. 7, the gear 338 engages with the driven gear 304. During the operation of the automatic dispensing apparatus 102, the pin 344, which is fixed to the side face of the limiter 332, is held in a standby position SB so that the gear 338 is not caused to engage with the gear 304 by a stopper portion 342 of a control lever 340 which is slidably supported in a vertical direction by the side frame 112. A notch 343 (see FIG. 8) is formed in an intermediate portion of the control lever 340 so as to be adjacent to the stopper portion 342. The notch 343 has a function of stopping rotation of the pin 344, and stopping rotation of the torque limiter 332 in a state in which the gear 338 engages with the driven gear 304. The unidirectional torque limiter 332 is preferably the one disclosed in, for example, Japanese Patent Application No. 3592948.

The position of the control lever 340 is switched between the standby position SB and an actuated position AP by a release mechanism 346. The release mechanism 346 of the lifting device 326 is described next with reference to FIGS. 2, 3, and 7. The release mechanism 346 has a release lever 348, a link lever 350, and a speed reducer frame 352. The release lever 348 is attached to a fixed axis 354 protruding from the speed reducer frame 352, in a pivotally operable fashion. The lever 350 is attached to a fixed axis 356 protruding from the side frame 112, in a pivotally operable fashion. The lever 350 is designed such that one end thereof is lifted up by the release lever 348. The other end of the lever 350 is link-coupled to the control lever 340 to move the control lever 340 in a vertical direction. The control lever 340 is guided by a guide, which is not shown, so as to move in a straight line in a vertical direction. A protrusion 358 and a locking concave portion 360 are formed in a lower portion of one end of the release lever 348, the protrusions 358 and the locking concave portion 360 being able to engage with a pin 362 which protrudes from the side frame 112. The speed reducer frame 352 is attached to a fixed axis 364 protruding from the side frame 112, in a pivotally operable fashion. It should be noted that the release lever 348 is biased by a spring (not shown) counterclockwise in FIG. 7. Therefore, by pressing a pressed piece 366 of the release lever 348, the release lever 348 is caused to pivotally operate clockwise in FIG. 7, whereby the concave portion 360 is removed from the pin 362. Accordingly, the speed reducer frame 352 can be caused to pivotally operate clockwise around the fixed axis 364, whereby the driving gear 288 can be removed from the intermediate gear 292. When the speed reducer frame 352 rotates by a predetermined amount, the protrusion 358 is stopped by the pin 362, and the rotation of the speed reducer frame 352 is stopped. Therefore, in this state, the table 262 can be lifted down while receiving braking force of the unidirectional torque limiter 332 via the transmitting device 282.

Figure 5:
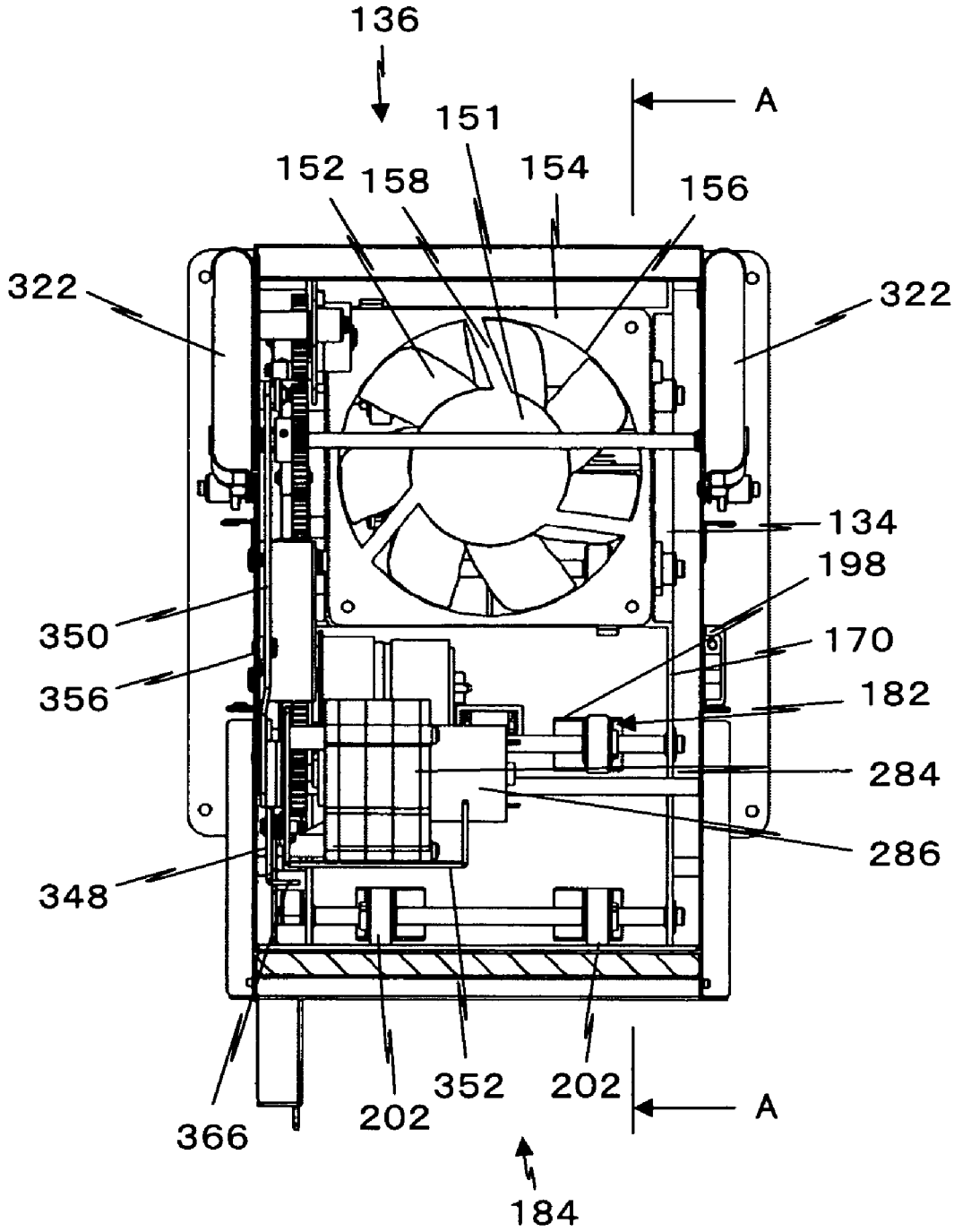
FIG. 5 is a cross-sectional view taken along a line B-B of FIG. 7.

A dispense detection sensor 370 is described next with reference to FIGS. 5 and 6. The dispense detection sensor 370 has a function of detecting that a rear end of the flat article 100 passes the first nip and conveyance device 182. On the basis of a passage detection signal of the dispense detection sensor 370, the functions of the lateral direction conveyance device 132 and the dispensing device 135 are stopped. In other words, the second electric motor 226 is stopped. The dispense detection sensor 370 is fixed to an upper surface of the base 138, and a contact 372 of the dispense detection sensor is disposed between the rollers 194 and is lifted up by the flat article 100 passing the dispensing path 186, whereby an ON signal is output. When the flat article 100 passes, the contact 372 protrudes to the dispensing path 186, and an OFF signal is output. When the rear end of the flat article 100 passes the contact 372, the leading end of the flat article 100 protrudes from the dispensing port 178, and is then pulled, whereby the flat article 100 can be received.

Figure 9:
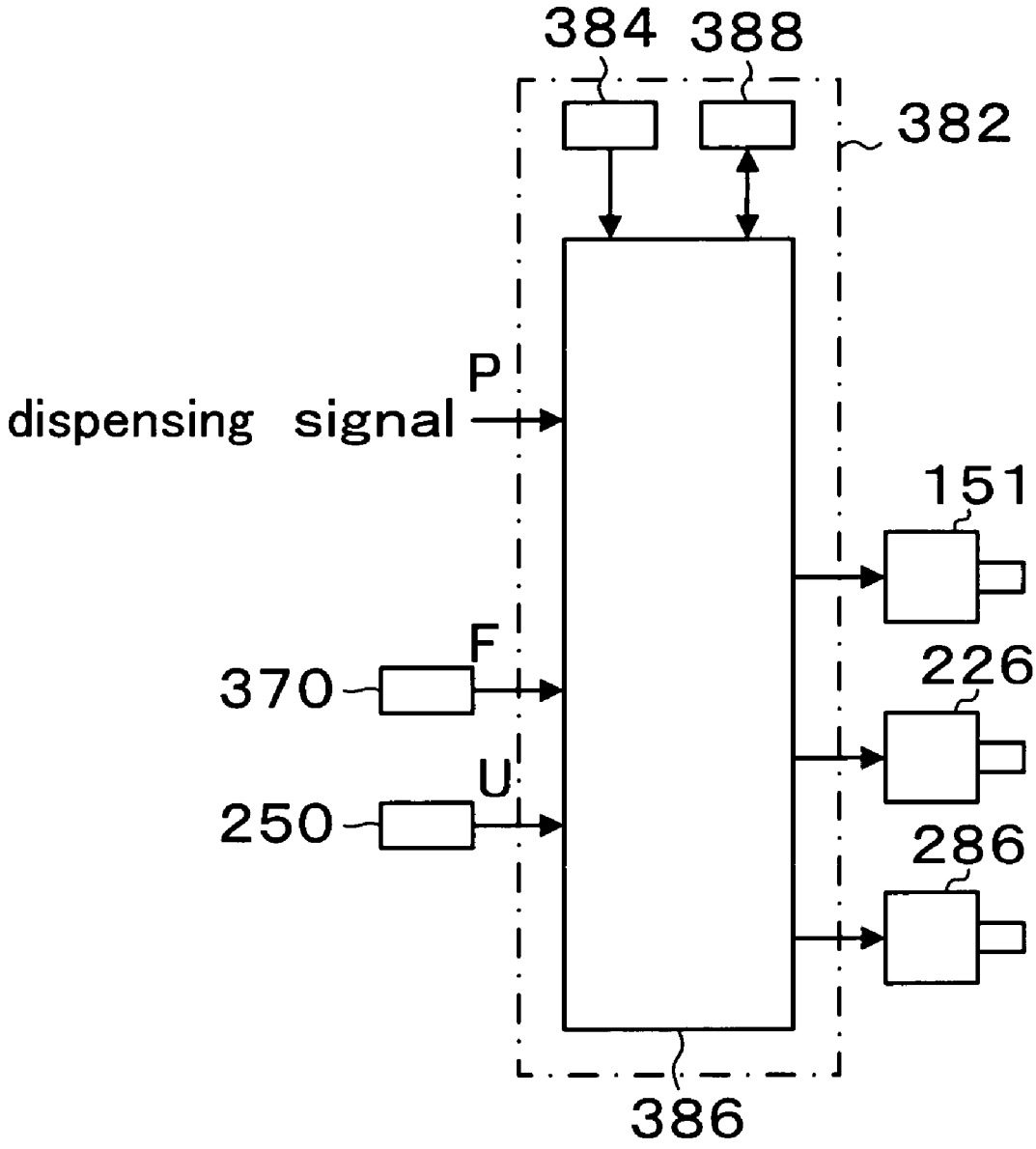
FIG. 9 is a block diagram of a control device of the automatic flat-article dispensing apparatus according to the embodiment of FIG. 1.
Figure 10:
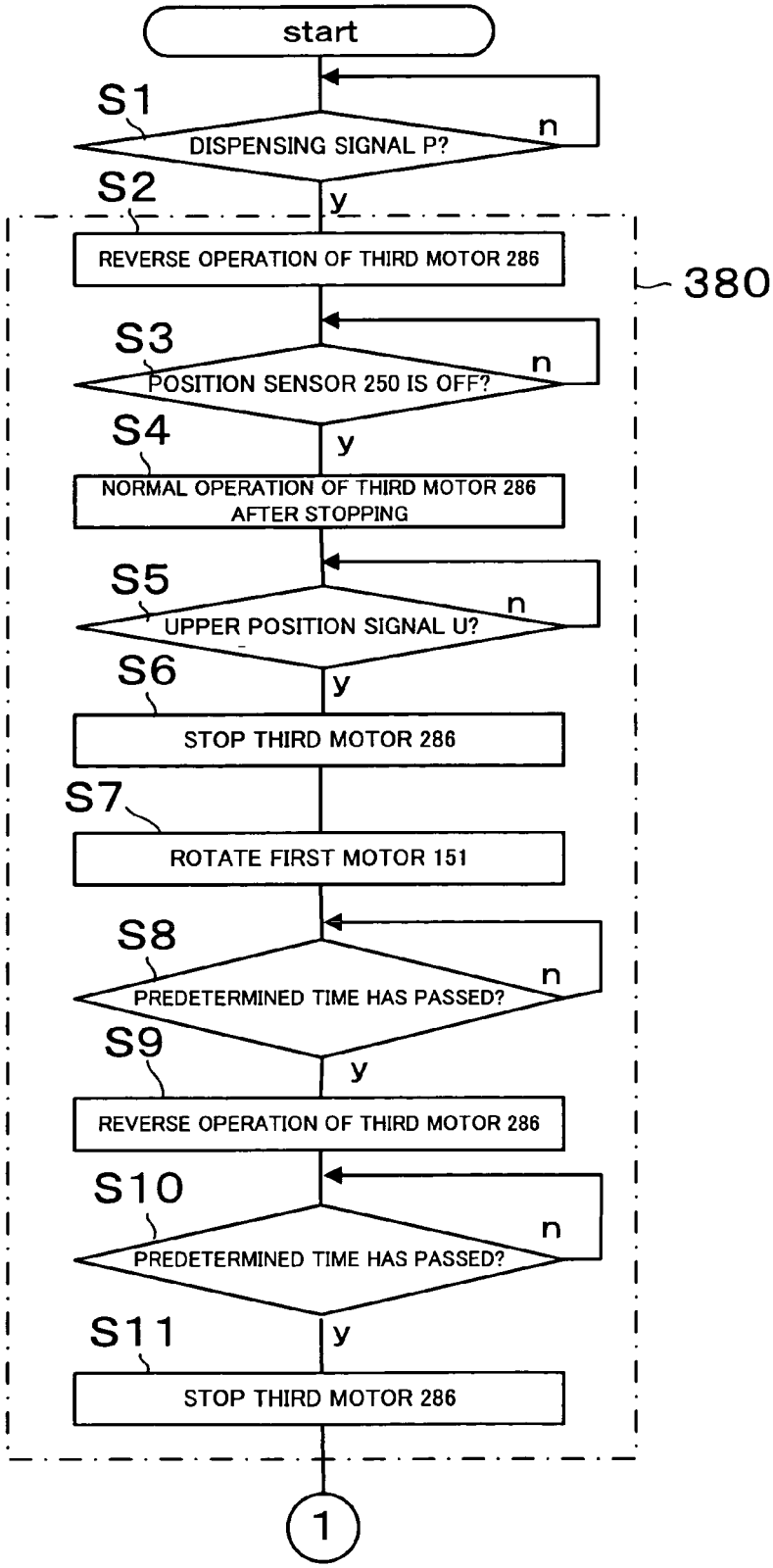
FIG. 10 is a flowchart of the action of the automatic flat-article dispensing apparatus according to the embodiment of FIG. 1.
Figure 11:
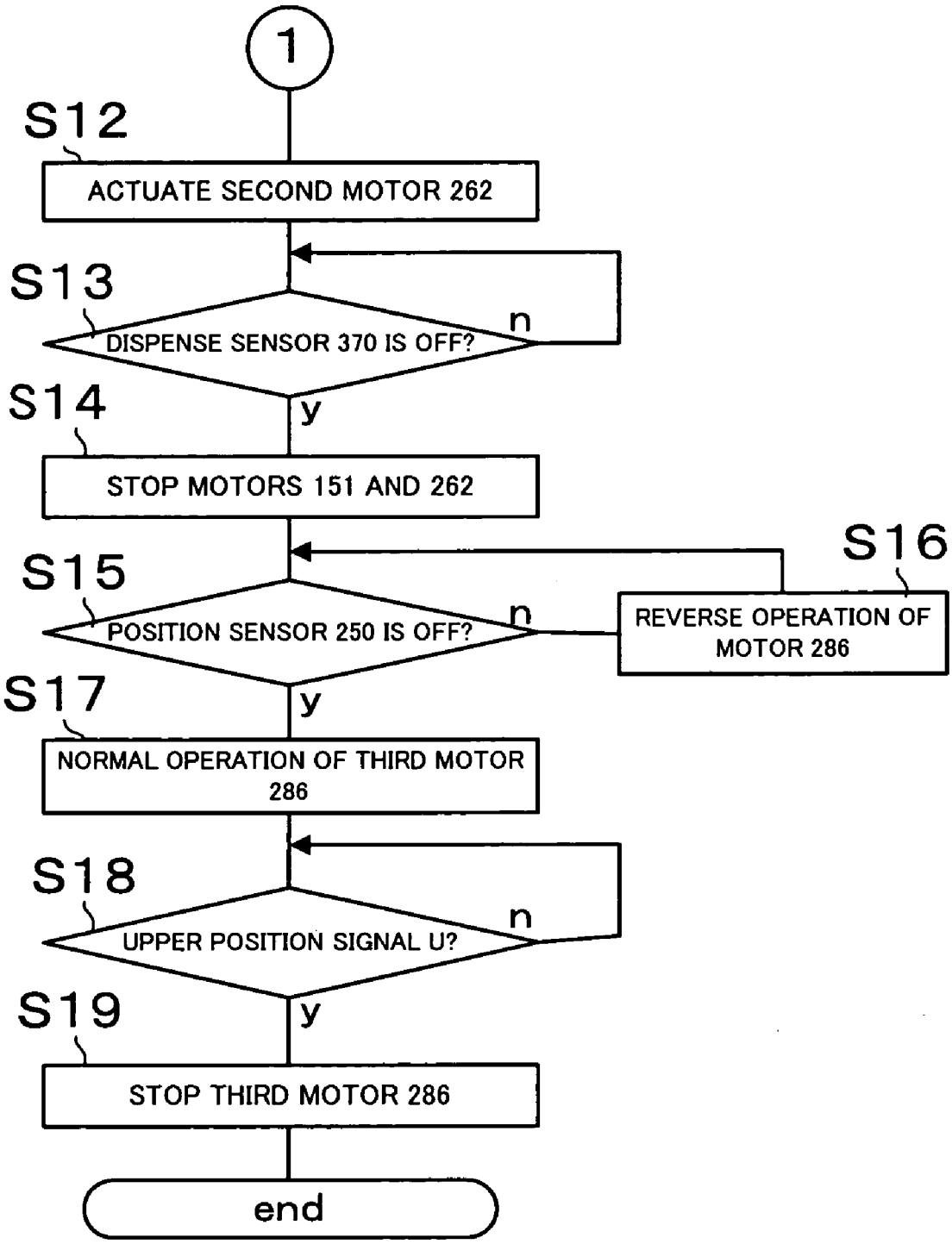
FIG. 11 is a flowchart of the action of the automatic flat-article dispensing apparatus according to the embodiment of FIG. 1.

A flat article position control device 380 is described next with reference to FIG. 9 through FIG. 11. In the present embodiment, the flat article position control device 380 is configured by a software, thus the control device is described with reference to FIG. 9 first. A main control circuit 382 is, for example, a microprocessor in which predetermined processing is carried out while a CPU 386 exchange data with a RAM 388 on the basis of a program stored in a ROM 384.

Specifically, actuation of each of the first electric motor 151, the second electric motor 226, and the third electric motor 286 is controlled on the basis of a dispense instruction signal P, an upper position signal U of the detection sensor 250, and a dispensing signal F of the dispense detection sensor 370. Actuation of the flat article position control device 380 is described next with reference to the flowcharts shown in FIGS. 10 and 11. At the time of activation, the pin 362 is engaged with the concave portion 360, and the driving gear 288 is engaged with the intermediate gear 292. Therefore, the control lever 340 is raised, and the gear 338 of the input axis 336 of the torque limiter 332 is removed from the driven gear 304 by the stopper portion 342. In Step S1, the dispense instruction signal P of the control device in an automatic vending machine is discriminated. When the dispense instruction signal P is present, the process proceeds to Step S2, in which the third electric motor 286 of the moving device 264 is rotated reversely. By the rotation of the motor 286, the pinion gear 298 is rotated clockwise in FIG. 7 via the speed reducer 284, the intermediate gears 292, 296, and 304, and the rotating axis 302. Accordingly, the rack 312 is moved downward, thus the table 262 and the flat article 100 on the table 262 move downward. By this downward movement, the contact 252, which is pushed up by the flat article 100, moves downward, and the detection sensor 250 outputs an OFF signal.

When the OFF signal is discriminated in Step S3, the process proceeds to Step S4, in which the motor 286 is rotated normally after being stopped. By this normal rotation, the pinion gear 298 is rotated counterclockwise in FIG. 7, thus the rack 312 move upward, and, as a result, the table 262 moves upward. By this upward movement of the table 262, the flat article 100 is lifted up and pushes up the contact 252, whereby the detection sensor 250 is switched ON and outputs the upper position signal U. When the upper position signal U is judged in Step S5, the process proceeds to Step S6, in which the third motor 286 is stopped. Accordingly, the table 262, and thus the top flat article 100 are positioned slightly below a lower surfaces of the rollers 174 which are located immediately below at least the first suction port 144 and the second suction port 146. In other words, the table 262 and the flat article 100 are positioned in a place which is opposite the entire surfaces of the first suction port 144 and the second suction port 146 and in which the top flat article 100 is definitely suctioned by the suction airflow. In Step S7, the first electric motor 151 of the suction airflow generation device 136 is rotated. By the rotation of the electric motor 151, the fan 152 is rotated, and the suction airflow for suctioning from the first suction port 144 and the second suction port 146 is generated. The top flat article 100 is suctioned by this suction airflow and is suctioned by the first suction port 144 and the second suction port 146. In other words, the top flat article 100 comes into contact with the lower surfaces of the first roller device 160 and the second roller device 162. In this state, since a space is present between the upper surface of the flat article 100 and the first suction port 144 and second suction port 146, the air is suctioned from the space, whereby predetermined suction force to the flat article 100 is maintained, and the airflow is caused to act on the first motor 151 and is then cooled off.

After time enough has passed for suctioning to be measured in Step S8, the process proceeds to Step S9. In Step S9 the third motor 286 is caused to rotate in a reverse manner. By the reverse rotation of the third motor 286, the pinion gear 298 is rotated clockwise in FIG. 7 via the speed reducer 284, the driving gear 288, the intermediate gears 292, 296, and 304, and the rotating axis 302. Accordingly, the rack 312 is moved downward, and the table 262 and other flat article 100, besides the flat article 100 which is on the table 262 and suctioned by and attached to the suction port 141, fall at low speed. By this downward movement, the flat article 100 which is suctioned by and attached to the first suction port 144 and the second suction port 146 is separated from the top flat article 100 on the table 262 by a predetermined distance. Moreover, since the table 262 moves at low speed, adhesion force by the negative pressure is not generated between the table 262 and the suctioned flat article 100. Therefore, the suctioned flat article 100 and the other flat article 100 adhered underneath move downward along with the falling table 262, and only the suctioned flat article 100 is continuously suctioned by the first suction port 144 and the second suction port 146. The predetermined distance described above is a distance in which the top flat article 100 on the table 262 is not suctioned after the flat article 100 suctioned by the first suction port 144 and the second suction port 146 is sent out. After time enough for this distant space is measured in Step S10, the rotation of the third motor 286 is stopped in Step S11. Accordingly, the gap space between the suctioned flat article 100 and the top flat article 100 on the table 262 is maintained.

Next, in Step S12, the second electric motor 226 of the lateral direction conveyance device 132 is rotated. By the rotation of the second electric motor 226, the rollers 174 of the lateral conveyance device 132 are rotated counterclockwise via the belt 228, the pulley 214, and the rotating axes 172, and the rollers 194 of the dispensing device 135 are rotated counterclockwise in FIG. 7 via the belt 288 and the pulley 216. The suctioned flat article 100 moved in a lateral direction to the left in FIG. 3 by frictionally contacting with the rollers 174, and is sent toward the dispensing device 135. The sent flat article 100 is nipped between the upper roller device 188 and the lower roller device 190 of the first nip and conveyance device 182 of the dispensing device 135, moved in the same direction, further nipped between the rollers of the second nip and conveyance device 184, and conveyed to the dispensing port 178. In this process, a relative area of the flat article 100 with respect to first suction port 144 becomes small gradually. In other words, an opening area of the first suction port 144 gradually increases, and the suction force to the flat article 100 decreases drastically. However, the entire surface of the second suction port 146 is placed opposite the flat article 100, thus the flat article 100 is continuously suctioned by the second suction port 146. Therefore, the flat article 100 is conveyed in a lateral direction while keeping its horizontal position. Then, when the leading end of the flat article 100 reaches immediately before the second nip and conveyance device 184, the rear portion of the flat article 100 starts to be removed from the second suction port 146, and the suction force to the flat article 100 decreases drastically. However, the leading end portion of the flat article 100 is regulated by the base 138 and the support plate 200. Therefore, when the rear end portion of the flat article 100 falls off the second suction port 146, the leading end portion of the flat article 100 is regulated by the base 138 and the support plate 200, nipped between the upper roller device 188 and the lower roller device 190 of the first nip and conveyance device 182 so as to be held substantially horizontally, and continued to be conveyed in the lateral direction. The flat article 100 is then nipped in the second nip and conveyance device 184, and is further conveyed in the lateral direction. Therefore, the leading end portion of the flat article 100 causes the shutter 206 to rotated clockwise, and protrudes from the dispensing port 178. The flat article 100 pushes the contact 372 up when passing the first nip and conveyance device 182, thus the dispense detection sensor 370 outputs the ON signal. When the rear end of the flat article 100 passes the first nip and conveyance device 182, the contact 372 moves downward, and the dispenses detection sensor 370 outputs the OFF signal. When the OFF signal is discriminated in Step S13, the process proceeds to Step S14.

In Step S14 the first electric motor 151 and the second electric motor 262 are stopped. Specifically, the suction airflow generation device 136 is stopped, ad the suction function of the suction device 130 is stopped. Moreover, the lateral direction conveyance device 132 and the dispensing device 135 are stopped.

Next, in Step S15, it is discriminated whether the detection sensor 250 is an OFF signal or not. Specifically, it is judged whether the top flat article 100 pushes up the contact 252. If the detection sensor 250 outputs the upper position signal U, the process proceeds to Step S16, in which the third motor 286 is operated reversely. Accordingly, the table 262 is moved down via the rack 312 similarly. Specifically, after the top flat article 100 is dispensed, in the case in which the next top flat article 100 pushes up the contact 252, there is a risk that this top flat article 100 is suctioned by the inertial operation of the suction device 130, and conveyed to the dispensing port 178 by the inertial operation of the lateral direction conveyance device 132. By moving the table 262 down and thus the flat article 100, the flat article 100 is prevented from being suctioned by the suction device 130 so that unnecessary dispensing is avoided.

Next, in Step S17, the third electric motor 286 is operated normally, and the table 262 is raised. The process proceeds to the next step S18, in which when the upper position signal U, which is sent from the detection sensor 250 by the top flat article 100 pushing up the contact 252, is discriminated, the process proceeds to Step S19. In Step S19, the third motor 286 is stopped, an optimal space of the top flat article 100 with respect to the first suction port 144 and the second suction port 146 is secured, and the output of the next dispensing signal is waited on.

The operation performed when resupplying flat article 100 on the table 262 is described next. First of all, the lock device 270 is released, and the door 266 is opened as shown in FIG. 2. Next, the pressed piece 366 is pressed, and the release lever 348 is pivotally operated clockwise in FIG. 7. Accordingly, the concave portion 360 moves to an upper portion of the pin 362, whereby the pin 362 can be pivotally operated clockwise in FIG. 7. The speed reducer frame 352 is pivotally operated clockwise (see FIG. 8) until the protrusion 358 is blocked by the pin 362. Accordingly, the driving gear 288 is removed from the gear 292. At the same time, one end of the link lever 350 is pivotally operated counterclockwise in FIG. 7 by an upper edge of the release lever 348, and the control lever 340 is moved downward. Therefore, the notch 343 is placed opposite the pin 344 of the unidirectional torque limiter 332. The torque limiter 332 receives a torque counterclockwise from the spring, and thus is pivotally operated counterclockwise around the fixed axis 334 as a supporting point, and the gear 338 engages with the driven gear 304. Furthermore, the pin 344 is stopped by the notch 343, and the torque limiter 332 maintains this state. In other words, the torque limiter 332 is held in the actuated position AP. Therefore, the torque limiter 332 is drive-coupled to the lifting device 326 (see FIG. 8). Although the table 262 tries to fall by means of the weights of the stacked flat articles 100, the table 262 receives the braking force by the resistance of the torque limiter 332. In other words, the table 262 falls at predetermined low speed until the lower end thereof is stopped by the base frame 122. Therefore, the flat article 100 does not fall suddenly, and defects such as damage to the flat article 100 are avoided. Thereafter, a new flat article 100 is placed on the table 262, and the door 266 is closed and locked with the lock device 270. Next, the speed reducer frame 352 is pressed and pivotally operated counterclockwise, and the driving gear 288 is engaged with the intermediate gear 292. Accordingly, the release lever 348 is pivotally operated counterclockwise, and the concave portion 360 engages with the pin 362. As a result, the link lever 350 is rotated clockwise in FIG. 8 by a biasing device, whereby the control lever 340 is pulled upward, the pin 344 pressed by an inclined portion of the notch 343, and the torque limiter 332 operated pivotally clockwise. Accordingly, the gear 338 is removed from the driven gear 304, and the lifting device 326 is drive-coupled to the driving device 280 (see FIG. 7).

As is clear from the above explanation, Step S2 through the Step S11 explain the flat article position control device 380. Specifically, the flat article position control device 380 has a function of separating the flat article 100 and the suction device 130 from each other, thereafter bringing the flat article 100 and the suction device 130 close to each other again so that the space between the flat article 100 and the suction device 130 becomes a predetermined space, thereafter suctioning the top flat article by means of the suction device 130, and then, again, separating the flat article 100 from the suction device 130. By configuring the flat article position control device 380 with a software, the components are not increased by a new component, thus the device can be created inexpensively.

Figure 12:
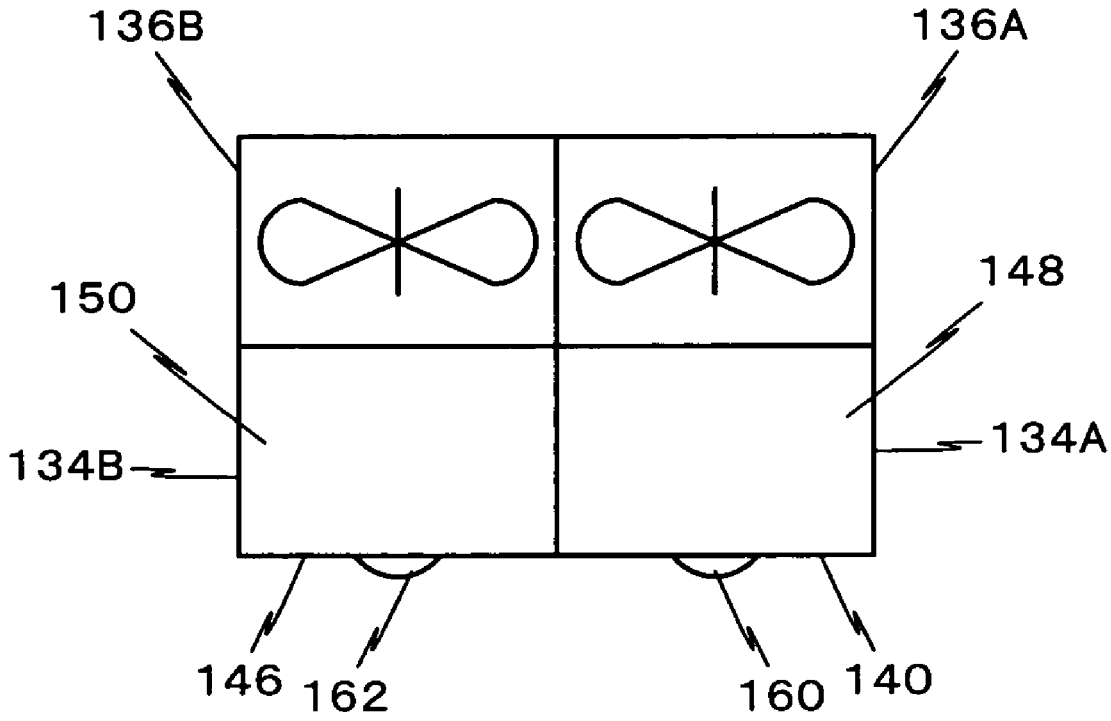
FIG. 12 is an explanatory diagram of the automatic flat-article dispensing apparatus according to a second embodiment of the invention.

A second embodiment is described next with reference to FIG. 12. The embodiment of FIG. 12 is an example in which two equalizer boxes 134A and 134B are provided, and suction airflow generation devices 136A and 136B are coupled thereto respectively. It should be noted that this then has three or more suction ports. However, since the production cost of such configuration is high, it is preferred that one suction device be created, and a plurality of suction ports be formed for an equalizer box, as in the embodiment of FIG. 1.

While specific embodiments of the invention have been shown and described in detail to illustrate the application of the principles of the invention, it will be understood that the invention may be embodied otherwise without departing from such principles.

What is claimed is:

1. An automatic flat-article dispensing apparatus comprising:

a table which supports stacked flat articles thereon, said stacked flat articles being stacked in a stacked direction;

a suction port disposed over the table and facing the flat articles, said suction port comprising a first suction port and a second suction port, said first suction port and said second suction port being disposed in a lateral direction with respect to said stacked direction;

a casing defining a circular hole;

an electric motor;

a partition wall intersecting with said lateral direction and extending in a direction perpendicular to said lateral direction;

a suction device comprising a cylindrical equalizer box having an upper opening and an axial-flow fan, said cylindrical equalizer box extending in a vertical direction, said cylindrical equalizer box being divided in said lateral direction into a first chamber and a second chamber via said partition wall, said first chamber and said second chamber having a predetermined capacity, wherein a lower end face of said first chamber defines said first suction port and a lower end face of said second chamber defines said second suction port, whereby a total length of said lower end face of said first chamber and said lower end face of said second chamber is shorter than a length of one of said stacked articles, said axial-flow fan being attached to said upper opening of said equalizer box such that said axial-flow fan is disposed opposite said first suction port and said second suction port, said axial-flow fan being located within said circular hole, said electric motor actuating said axial-flow fan such that said axial-flow fan rotates about an axis perpendicular to said lateral direction, said suction device suctioning a top flat article of the stacked flat articles by sucking air through said first suction port and said second port such that air is suctioned from a small space defined by a lower end of said equalizer box and said top flat article, said first suction port and said second suction port holding the top flat article; and a conveyance device for conveying the flat article sucked via the suction port in said lateral direction, said conveyance device being disposed within said first chamber and said second chamber.

2. An automatic flat-article dispensing apparatus according to claim 1, wherein said suctioning device suctions air along an axial air flow path, said axial air flow path being defined by said first chamber, said second chamber, said first suction port, said second suction port and said small space defined by said lower end of said equalizer box and said top flat article.

3. An automatic flat-article dispensing apparatus according to claim 1, wherein said motor is located within said casing such that said motor is adjacent said axial-flow fan.

4. An automatic flat-article dispensing apparatus for dispensing flat-articles, the apparatus comprising:

a support platform defining a surface with a stack of the flat articles thereon;

a suction port means defining a first suction port and a second suction port disposed over a table and facing the flat articles, said first suction port and said second suction port being disposed one after another in a lateral direction with respect to a direction of the stack;

a casing defining a hole;

a dividing wall intersecting said lateral direction and extending in a direction perpendicular to said lateral direction;

a motor;

a suction device operatively connected to said suction port means, said suction device comprising an axial-flow fan and a cylindrical equalizer box having an upper surface defining an upper opening, said cylindrical equalizer box extending in a vertical direction, said dividing wall dividing said cylindrical equalizer box into a first chamber and a second chamber, said first chamber being in communication with said first suction port and said second chamber being in communication with said second suction port, said axial-flow fan being located within said casing such that said axial-flow fan is opposite said hole of said casing and said first and second suction port, said hole of said casing being in communication with said upper opening of said upper opening of said cylindrical equalizer box, said motor rotating said axial-flow fan about an axis perpendicular to said lateral direction for generating suction to suction a top flat article of the stacked flat articles by sucking air through an axial fluid flow path, said axial fluid flow path being defined via said first suction port and said second suction port, said first chamber and said second chamber and a spaced defined by a lower end of said equalizer box and one of said flat articles, one or both of said first suction port and said second suction port holding the top flat article; and a conveyance device for conveying the flat article sucked via said first and second suction port in said lateral direction, wherein one portion of said conveyance device is disposed within said first chamber and another portion of said conveyance device is disposed within said second chamber.

5. An automatic flat-article dispensing apparatus according to claim 4, wherein a total length of said first suction port and said second suction port is less than a length of each flat article.

6. An automatic flat-article dispensing apparatus according to claim 4, wherein said first chamber and said second chamber have a predetermined capacity.

7. An automatic flat-article dispensing apparatus according to claim 4, wherein said motor is located within said casing such that said motor is adjacent said axial-flow fan.

8. An automatic flat-article dispensing apparatus for dispensing flat-articles, the apparatus comprising:

a support platform defining a surface with a stack of the flat articles thereon;

a casing defining a casing hole;

a suction device for suctioning a top flat article of the stacked flat articles, said suction device including an equalizer box with a predetermined dimension extending in a vertical direction, which is sectioned by a partition wall in the lateral direction to define, a first chamber and second chamber, an end face of the first chamber defining a first suction port disposed over a table and facing the flat articles, and another end face of said second chamber defining a second suction port disposed over the table and facing the flat articles and a suction airflow generation device attached to said equalizer box, said equalizer box having a top surface defining a top hole, said suction airflow generation device being located within said casing such that said suction airflow generation device is opposite said casing hole and said top hole, said top hole being in communication with said casing hole, said suction airflow generation device sucking air through an air flow path defined by said first suction port, said second suction port, said first chamber, said second chamber, said space, said casing hole and said top hole, one or both of said first suction port and said second suction port holding the top flat article, said first suction port and said second suction port being disposed one after another in a lateral direction with respect to the direction of the stack; and a conveyance device for conveying the flat article sucked via said first and second suction ports in said lateral direction, wherein one part of said conveyance device is located within said first suction port and another part of said conveyance device is located within said second suction port.

9. An automatic flat-article dispensing apparatus according to claim 8, wherein said suction airflow generation device is an axial-flow fan which is rotated by an electric motor.

10. An automatic flat-article dispensing apparatus according to claim 8, wherein said partition wall intersects with said lateral direction and extends in a direction perpendicular to said lateral direction.

11. An automatic flat-article dispensing apparatus according to claim 10, wherein said first chamber and said second chamber have a predetermined capacity.

12. An automatic flat-article dispensing apparatus according to claim 11, wherein a total length of said first suction port and said second suction port is less than a length of each flat article.

13. An automatic flat-article dispensing apparatus according to claim 12, wherein said suction airflow generation device is located opposite said first suction port and said second suction port.

14. An automatic flat-article dispensing apparatus according to claim 13, further comprising an electric motor.

15. An automatic flat-article dispensing apparatus according to claim 14, wherein said electric motor is located within said casing such that said motor is adjacent said suction airflow generation device.

16. An automatic flat-article dispensing apparatus according to claim 15, wherein said electric motor rotates said suction airflow generation device about an axis perpendicular to said lateral direction.

17. An automatic flat-article dispensing apparatus according to claim 4, wherein said first chamber and said second chamber are in communication with said upper opening of said cylindrical equalizer box.

* * * * *